US008398823B2

(12) United States Patent
Mielke

(10) Patent No.: US 8,398,823 B2
(45) Date of Patent: Mar. 19, 2013

(54) PRESS FELT AND ITS USE

(75) Inventor: Jürgen Mielke, Bamberg (DE)

(73) Assignee: Siemens Aktiengesellschaft, Munich (DE)

( * ) Notice: Subject to any disclaimer, the term of this patent is extended or adjusted under 35 U.S.C. 154(b) by 135 days.

(21) Appl. No.: 12/839,589

(22) Filed: Jul. 20, 2010

(65) Prior Publication Data

US 2011/0017418 A1 Jan. 27, 2011

(30) Foreign Application Priority Data

Jul. 23, 2009 (DE) ..... 10 2009 034 383

(51) Int. Cl.
*D21F 7/08* (2006.01)
*D03D 1/00* (2006.01)

(52) U.S. Cl. ..... 162/358.2; 162/900; 139/383 B; 139/383 AA; 442/320

(58) Field of Classification Search .... 162/358.1–358.2, 162/900, 904; 442/268–270, 320, 334–337, 442/373, 383, 402, 406; 139/383 A, 383 B, 139/383 R; 28/110, 142, 159; 156/60
See application file for complete search history.

(56) References Cited

U.S. PATENT DOCUMENTS

| | | | | | |
|---|---|---|---|---|---|
| 630,573 | A * | 8/1899 | Smith | 139/391 |
| 1,722,764 | A * | 7/1929 | Rasch | 442/240 |
| 2,165,772 | A * | 7/1939 | Walsh et al. | 442/326 |
| 2,271,295 | A * | 1/1942 | Gates | 428/88 |
| 3,158,984 | A * | 12/1964 | Butler | 57/210 |
| 3,657,068 | A * | 4/1972 | Ivanowicz | 162/358.2 |
| 4,119,753 | A * | 10/1978 | Smart | 442/187 |
| 4,187,618 | A * | 2/1980 | Diehl | 34/523 |
| 4,206,258 | A * | 6/1980 | Balcar | 428/131 |
| 4,361,618 | A * | 11/1982 | Dufour et al. | 442/206 |
| 4,425,392 | A * | 1/1984 | Oikawa et al. | 428/90 |
| 4,537,816 | A * | 8/1985 | Booth et al. | 442/206 |
| 4,746,546 | A * | 5/1988 | Bachmann et al. | 427/206 |
| 4,943,476 | A * | 7/1990 | Sokaris | 442/187 |
| 5,998,310 | A * | 12/1999 | Bowen, Jr. | 442/196 |
| 6,171,446 | B1 * | 1/2001 | Diaz-Kotti | 162/358.2 |
| 6,425,985 | B1 * | 7/2002 | Hagfors et al. | 162/358.2 |
| 6,875,314 | B2 * | 4/2005 | Korfer et al. | 162/358.2 |
| 7,101,404 | B2 * | 9/2006 | Korfer | 8/114.6 |
| 2006/0180292 | A1 * | 8/2006 | Kleiser et al. | 162/358.1 |
| 2007/0254546 | A1 * | 11/2007 | Despault | 442/366 |
| 2009/0288731 | A1 * | 11/2009 | Chang et al. | 139/383 R |
| 2010/0043997 | A1 * | 2/2010 | Crook et al. | 162/358.1 |
| 2010/0043998 | A1 * | 2/2010 | Ohuchi | 162/358.2 |
| 2011/0017418 | A1 * | 1/2011 | Mielke | 162/205 |

FOREIGN PATENT DOCUMENTS

| | | |
|---|---|---|
| DE | 10204357 A1 * | 8/2003 |
| DE | 10204357 | 10/2006 |

(Continued)

OTHER PUBLICATIONS

German Office Action for Application No. 10 2009 034 383.0 (2 pages), Mar. 9, 2010.

*Primary Examiner* — Jose A Fortuna
(74) *Attorney, Agent, or Firm* — King & Spalding L.L.P.

(57) ABSTRACT

A press felt (1) has a front side (1*a*), a rear side (1*b*) and fibers (2, 2*a*, 2*b*, 2*c*, 2*d*, 2*e*, 2*f*, 2*g*) which, on their fiber surface, have channels (20) which extend between a first end (11) and a second end (12) of the respective fiber (2, 2*a*, 2*b*, 2*c*, 2*d*, 2*e*, 2*f*, 2*g*), the first end (11) pointing in the direction of the front side (1*a*) and the second end (12) pointing in the direction of the rear side (1*b*). Furthermore, the press felt (1) can be used for mechanically dewatering a paper web (100) in a paper-making machine.

15 Claims, 7 Drawing Sheets

FOREIGN PATENT DOCUMENTS

| | | | | |
|---|---|---|---|---|
| DE | 102005047345 | | | 4/2007 |
| DE | 102006004106 | A1 | * | 8/2007 |
| DE | 102007024509 | | | 12/2008 |
| DE | 102009034383 | A1 | * | 2/2011 |
| EP | 995835 | A1 | * | 4/2000 |
| JP | 2011026761 | A | * | 2/2011 |

* cited by examiner

PRESS FELT AND ITS USE

CROSS-REFERENCE TO RELATED APPLICATIONS

This application claims priority to DE Patent Application No. 10 2009 034 383.0 filed Jul. 23, 2009. The contents of which is incorporated herein by reference in its entirety.

TECHNICAL FIELD

The invention relates to a press felt having a front side, a rear side and comprising fibers which, on their fiber surface, have channels which extend between a first end and a second end of the respective fiber. Furthermore, the invention relates to the use of a press felt of this type for mechanically dewatering a paper web in a papermaking machine.

BACKGROUND

Press felts are used, for example, as fabrics in the wet end of a papermaking machine and are known in a multiplicity of embodiments. Press felt fabrics of this type are an endlessly circulating belt which usually extends over the entire machine width and serves to dewater the paper web in the pressing section of the papermaking machine. In order that the paper web is given a smooth surface free of markings, press felts are as a rule used which have a smooth surface and a uniformly resilient structure. At the same time, a press felt requires a sufficiently high open porosity in order to absorb the water which is to be removed from the wet paper web.

The press felt is pressed against the paper web for mechanically dewatering the paper web by means of a roll which usually has a surface profile for conducting away the water which has been pressed out of the paper web. Here, water contained in the paper web passes into the press felt and, in the ideal case, is transported away completely by the latter in the direction of the roll.

A basic requirement of the fabrics in the pressing section of a papermaking machine comprises dewatering the paper web as much as possible, in order to minimize the energy outlay for the drying section of the paper web which adjoins the pressing section. Rewetting, that is to say part of the water already pressed out of the paper web being sucked back out of the press felt into the paper web, which occurs when the contact pressure of the press felt against the paper web decreases, is to be avoided as far as possible.

The maximum achievable dryness at the outlet of the pressing section of a papermaking machine is limited, however, by adsorption and capillary forces which bind the water within the paper web and on the paper web surface. Theoretically, a dryness of the paper web of from 72 to 76% can be achieved here. In practice, however, only drynesses of at most from 50 to 52% are being achieved at present.

Press felts of the type mentioned in the introduction are known, for example, from DE 102 04 357 B4. The press felt described here has a carrier which has at least one layer of a laid scrim with scrim threads which run parallel to one another and in the plane of the press felt, and is embedded into a fiber matrix. Here, the scrim threads are provided with outwardly projecting fibers and are equipped with channels in order to improve the dewatering properties on their surface, which channels extend between a first end and a second end of the respective scrim threads.

SUMMARY

According to various embodiments, a press felt can be provided, by way of which the mechanical dewatering of paper webs in a papermaking machine can be improved further.

According to an embodiment, a press felt may have a front side, a rear side and may comprise fibers which, on their fiber surface, have channels which extend between a first end and a second end of the respective fiber, characterized in that the first end points in the direction of the front side and the second end points in the direction of the rear side.

According to a further embodiment, a) a fiber cross section of the respective fiber can be reduced in the direction of the second end, starting from the first end, or b) the press felt has at least two felt layers and a fiber cross section of the fibers which are contained in the respective felt layer can be reduced as the spacing increases of a felt layer from the front side of the press felt. According to a further embodiment, in case a), the fibers may extend from the front side to the rear side of the press felt. According to a further embodiment, in case a), the fibers may differ with regard to a number and/or arrangement of the channels. According to a further embodiment, in case b), the fibers may extend over a thickness of a felt layer. According to a further embodiment, in case b), the at least two fiber layers may differ, furthermore, the fibers which are contained in them may differ with regard to their number and/or a number and/or arrangement of the channels. According to a further embodiment, the proportion of fibers in the press felt can be at least 1% by volume, in particular at least 5% by volume. According to a further embodiment, the fibers can be formed by microfibers. According to a further embodiment, the fibers may be arranged in fiber bundles. According to a further embodiment, the fibers may have a star-shaped or cross-shaped fiber cross section. According to a further embodiment, the channels may extend helically from the first end in the direction of the second end of the respective fiber. According to a further embodiment, the fibers or fiber bundles can be arranged orthogonally with respect to the front side of the press felt. According to a further embodiment, the fibers can be adhesively bonded to a carrier structure. According to a further embodiment, the carrier structure can be formed by a knitted fabric and/or a woven fabric and/or laid fiber fabrics.

According to another embodiment, a press felt as described above can be used for mechanically dewatering a paper web in a papermaking machine, the press felt being pressed with its front side against the paper web by means of a roll which is provided with a surface profile.

BRIEF DESCRIPTION OF THE DRAWINGS

FIGS. 1*a* to 12 are to explain the various embodiments by way of example. In the drawing:

FIG. 1*a* diagrammatically shows a cross section through a press felt,

FIGS. 7*a* to 11*b* show different cross sections of fibers having channels, and FIG. 12 shows a diagrammatic overview of the dewatering profile of a paper web.

DETAILED DESCRIPTION

Figure 1A:
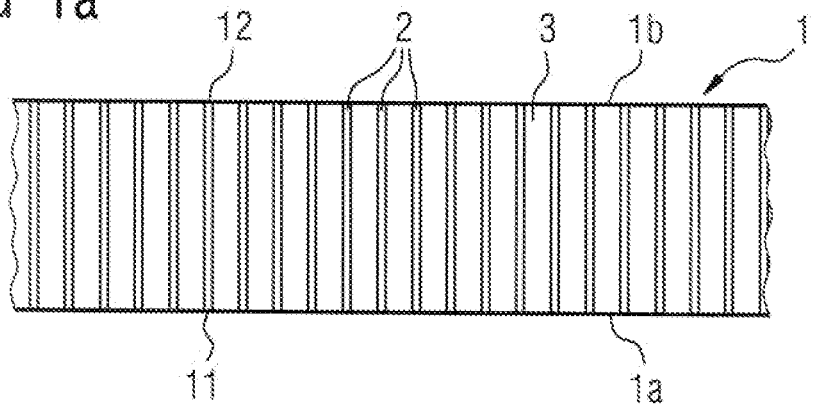

According to various embodiments, a press felt having a front side, a rear side and may comprise fibers which, on their fiber surface, have channels which extend between a first end and a second end of the respective fiber, by the first end pointing in the direction of the front side and the second end pointing in the direction of the rear side.

Accordingly, the fibers which comprise the channels are oriented in the direction of, or substantially in the direction of, the transporting away of the water, accordingly in the direction of the roll in the papermaking machine, with the result that water which is pressed into the channels when the press felt is pressed onto a damp paper web is retained in the fiber on account of the capillary forces which also act here. Here, the capillary forces which act in the channels counteract the adsorption and capillary forces which act in the paper web, with the result that, when the paper web is relieved, rewetting of the paper web is reduced or, in the ideal case, prevented completely.

This results in an increase in the achievable dryness of the paper web which in turn is reflected in lower energy consumption and a lower produced amount of water steam in a subsequent thermal dewatering step. The outlay in machine terms and the outlay on energy for mechanical dewatering of the paper web are considerably lower than for thermal dewatering. If an approximately 1% higher dryness of the paper web is achieved at the outlet of a pressing section, the amount of water to be evaporated during the following thermal dewatering is reduced by approximately 4%, which corresponds to a saving of water steam of 4%. The costs for procuring and operating the papermaking machine are reduced correspondingly.

Accordingly, the use of a press felt according to various embodiments for mechanical dewatering of a paper web in a papermaking machine, the press felt being pressed with its front side against the paper web by means of a roll which is provided with a surface profile, can be ideal. A modification of the pressing section of a papermaking machine, in particular with regard to the structural design or pressing force of the press felt, is not required if the press felt according to various embodiments is used. The quality of the finished paper web with regard to smoothness, thickness, printing ink absorption capability, opacity, etc. is not changed or is not changed substantially by the use of the press felt according to various embodiments.

Further embodiments of the press felt will be indicated in the following text.

The press felt may be particularly preferably configured in such a way that a) a fiber cross section of the respective fiber is reduced in the direction of the second end, starting from the first end, or b) the press felt has at least two felt layers and a fiber cross section of the fibers which are contained in the respective felt layer is reduced as the spacing increases of a felt layer from the front side of the press felt. As a result, the transporting away in the direction of the roll of the water which is pressed out of the paper web is improved again and the capillary forces which act in the fibers which have the channels are increased further. As a result, the achievable dryness of a paper web at the outlet of a pressing section can be increased once more.

In case a), the fibers preferably may extend from the front side to the rear side of the press felt. As a result, continuous and uniform transporting away of water can be achieved over the entire thickness of the press felt.

Furthermore, it is advantageous if, in case a), the fibers differ with regard to a number and/or arrangement of the channels. As a result, the capillary forces which act in the press felt can be set locally in a targeted manner, such as in the region of the edges of the paper web.

It has been tried and tested for case b) if the fibers extend over the thickness of a felt layer. As a result, continuous and uniform transporting away of water can be achieved over the entire thickness of a felt layer.

In case b), it is additionally advantageous if the at least two felt layers differ, furthermore, in that the fibers which are contained in them differ with regard to their number and/or a number and/or arrangement of the channels. As a result, the capillary forces which act in the press felt can be set locally in a targeted manner, such as in the region of the edges of the paper web.

The proportion of fibers in the press felt which have the channels may be preferably at least 1% by volume, in particular at least 5% by volume. In particular, the proportion can be more than 25% by volume. The higher the proportion of fibers, the higher the capillary forces in the press felt which counteract rewetting of the paper web.

In one embodiment, the fibers are formed by microfibers. The expression microfiber is a collective term for fibers which are finer than 1 dtex. Most microfibers lie between 0.5 and 0.7 dtex. Even thinner fibers of less than 0.3 dtex are called supermicrofibers and can likewise be used here.

The fibers which may be used preferably can have a star-shaped or cross-shaped fiber cross section. However, other cross sections can also be used, for example in the shape of a cloverleaf or the like, in which channels are formed in the longitudinal direction of the fiber.

It has been tried and tested here to improve the dewatering properties further if the channels extend helically from the first end in the direction of the second end of the respective fiber.

In a further embodiment, the fibers which have the channels are arranged in fiber bundles.

Here, the fibers or fiber bundles can preferably be arranged orthogonally with respect to the front side of the press felt. As a result, the path of the water which has been pressed out of the paper web in the press felt is reduced. However, an oblique arrangement of the longitudinal axis of the fibers with respect to the front side of the press felt is also possible.

It has proven favorable if the fibers are adhesively bonded to a carrier structure. The carrier structure may preferably be a knitted fabric and/or a woven fabric and/or laid fiber fabrics.

FIG. 1*a* diagrammatically shows a cross section through a press felt 1. The press felt 1 has a front side 1*a*, a rear side 1*b* and fibers 2 which have, on their fiber surface, channels 20 (see FIGS. 7*a* to 11*b*) which extend between a first end 11 and a second end 12 of the respective fiber 2. Here, the first end 11 points in the direction of the front side 1*a* and the second end 12 points in the direction of the rear side 1*b* of the press felt 1, an orthogonal arrangement of the fibers 2 with respect to the front side 1*a* or rear side 1*b* being selected here. The fibers 2 are carried by a carrier structure 3 which is formed, for example, by a woven fabric (not shown here in greater detail for improved clarity), knitted fabric, laid fiber fabrics or the like. Instead of the fibers 2, there can also be fiber bundles, in which a number of fibers 2 are present in the same orientation in the press felt 1. The front side 1*a* is arranged in a papermaking machine so as to face the paper web 100 (see FIG. 12).

Figure 1B:
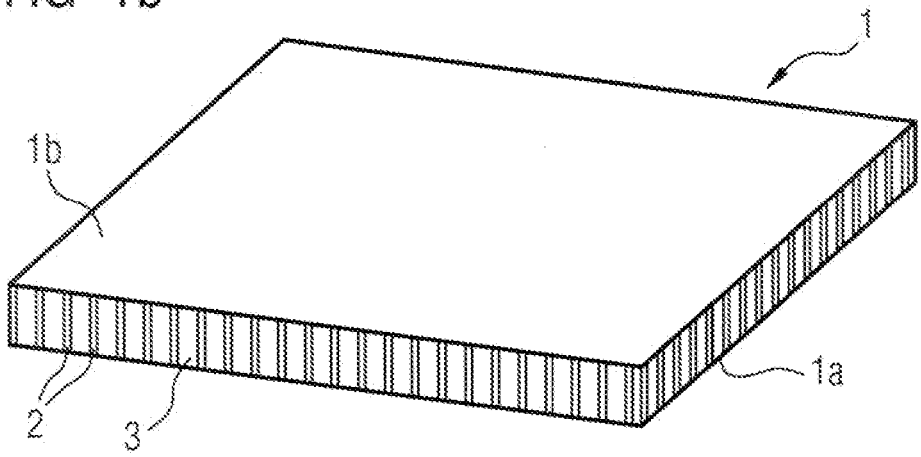
FIG. 1*b* shows the press felt according to FIG. 1*a* in a diagrammatic three-dimensional view, FIG. 2*a* diagrammatically shows a cross section through a further press felt.

FIG. 1*b* shows the press felt 1 according to FIG. 1*a* in a diagrammatic, three-dimensional view.

Figure 2A:
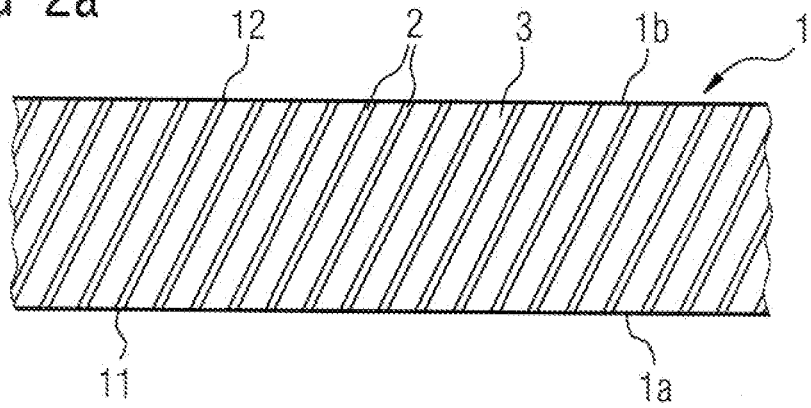

FIG. 2*a* diagrammatically shows a cross section through a further press felt 1. The press felt 1 has a front side 1*a*, a rear side 1*b* and fibers 2 which have, on their fiber surface, channels 20 (see FIGS. 7*a* to 11) which extend between a first end 11 and a second end 12 of the respective fiber 2. Here, the first end 11 points in the direction of the front side 1*a* and the second end 12 points in the direction of the rear side 1*b* of the press felt 1, an oblique arrangement of the fibers 2 with respect to the front side 1*a* or rear side 1*b* being selected here. The fibers 2 are carried by a carrier structure 3 which is formed, for example, by a woven fabric (not shown here in greater detail for improved clarity), knitted fabric, laid fiber fabrics or the like. Instead of the fibers 2, there can also be fiber bundles, in which a number of fibers 2 are present in the same orientation in the press felt 1. The front side 1*a* is arranged in a papermaking machine so as to face the paper web 100 (see FIG. 12).

Figure 2B:
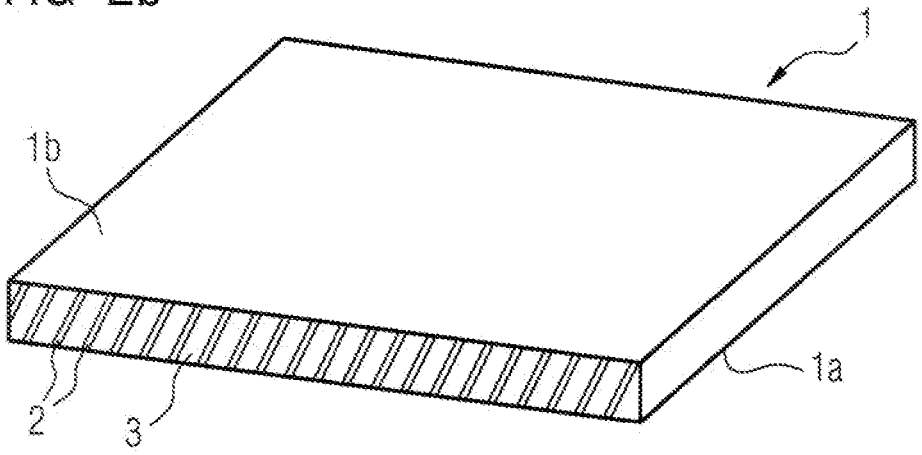
FIG. 2*b* shows the press felt according to FIG. 2*a* in a diagrammatic three-dimensional view, FIG. 3 diagrammatically shows a cross section through a press felt having two felt layers, FIG. 4 diagrammatically shows a cross section through a further press felt having two felt layers, FIG. 5 diagrammatically shows a cross section through a further press felt having two felt layers, FIG. 6 diagrammatically shows a cross section through a further press felt having two felt layers.

FIG. 2*b* shows the press felt 1 according to FIG. 2*a* in a diagrammatic, three-dimensional view.

Figure 3:
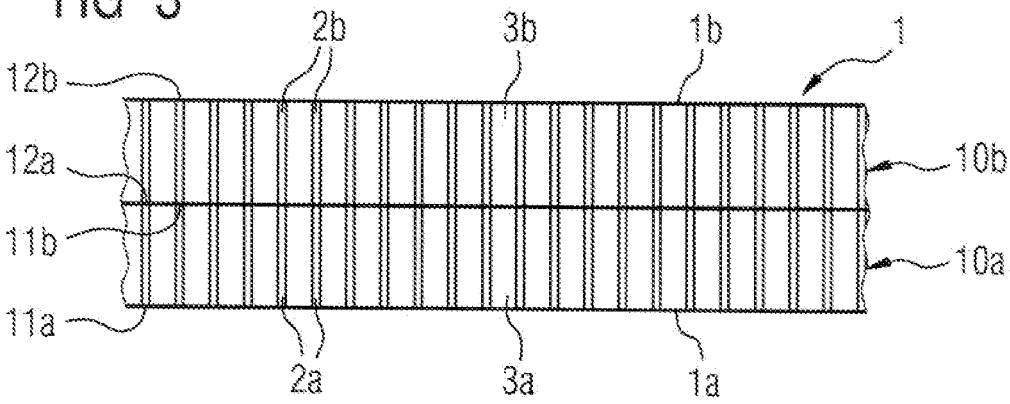

FIG. 3 diagrammatically shows a cross section through a press felt 1 having two felt layers 10*a*, 10*b*, which press felt 1 has a front side 1*a* and a rear side 1*b*. Fibers 2*a*, 2*b* are contained in each of the felt layers 10*a*, 10*b*, which fibers 2*a*, 2*b* have, on their fiber surface, channels 20 (see FIGS. 7*a* to 11*b*) which extend between a first end 11*a*, 11*b* and a second end 12*a*, 12*b* of the respective fiber 2*a*, 2*b*. Here, the first end 11*a*, 11*b* points in the direction of the front side 1*a* and the second end 12*a*, 12*b* points in the direction of the rear side 1*b* of the press felt, an orthogonal arrangement of the fibers 2*a*, 2*b* with respect to the front side 1*a* or rear side 1*b* being selected here. Furthermore, the fibers 2*a*, 2*b* in the felt layers 10*a*, 10*b* are arranged above one another in such a way that a fiber 2*b* adjoins each fiber 2*a* as far as possible. The fibers 2*a*, 2*b* are carried in each case by a carrier structure 3*a*, 3*b* which is formed, for example, by a woven fabric (not shown in greater detail here for improved clarity), knitted fabric, laid fiber fabrics or the like. The front side 1*a* is arranged in a papermaking machine so as to face the paper web 11 (see FIG. 12).

Figure 4:
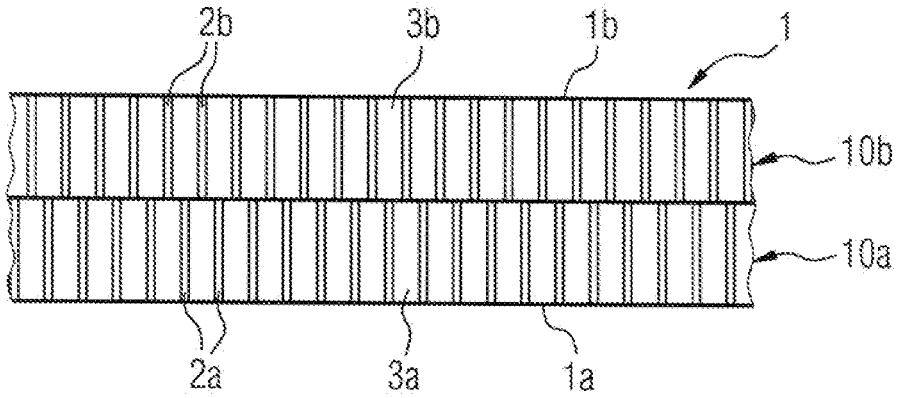

FIG. 4 diagrammatically shows a cross section through a further press felt 1 in a similar manner to FIG. 3. The same designations label identical components. In contrast to FIG. 3, however, the fibers 2*a*, 2*b* are arranged above one another here in such a way that the fibers 2*b* are arranged offset with respect to the fibers 2*a*.

Figure 5:
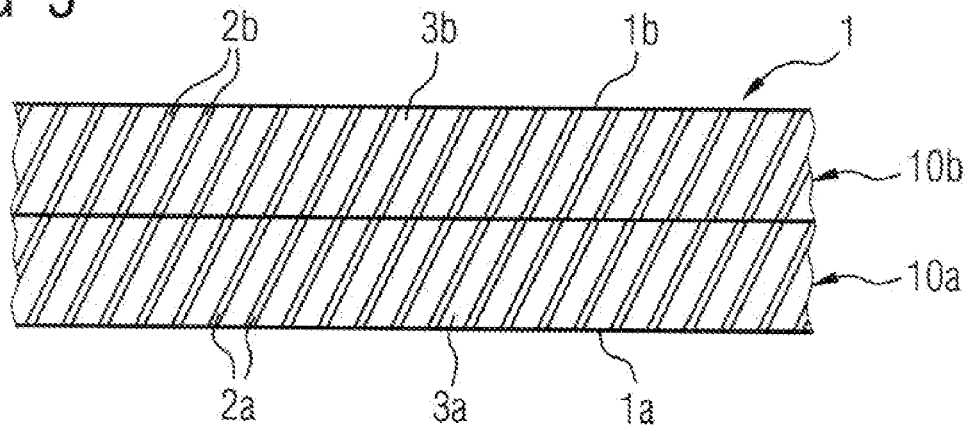

FIG. 5 diagrammatically shows a cross section through a further press felt 1 having two felt layers 10*a*, 10*b*, which press felt 1 is of similar construction to that in FIG. 3. The same designations label identical components. In contrast to FIG. 3, however, the fibers 2*a*, 2*b* are arranged obliquely here with respect to the front side 1*a* or rear side 1*b* of the press felt 1.

Figure 6:
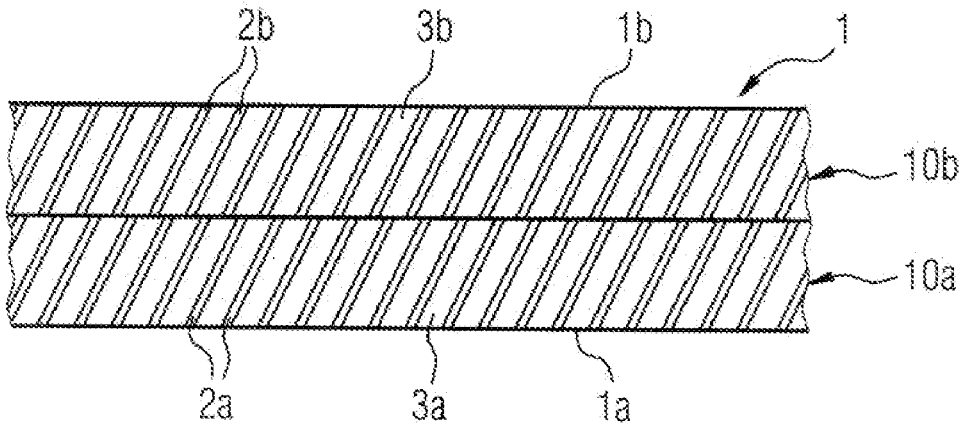

FIG. 6 diagrammatically shows a cross section through a further press felt 1 having two felt layers 10*a*, 10*b*, which press felt 1 is of similar construction to that in FIG. 4. The same designations label identical components. In contrast to FIG. 4, however, the fibers 2*a*, 2*b* which are arranged offset with respect to one another are arranged obliquely here with respect to the front side 1*a* or rear side 1*b* of the press felt 1.

It goes without saying that there can also be more than two felt layers 10*a*, 10*b* in a press felt 1, as is shown merely by way of example in FIGS. 3 to 6.

For the embodiments, in which the press felt 1 has at least two felt layers 10*a*, 10*b*, the fibers 2*a* preferably may have a greater cross section in the felt layer 10*a* which adjoins the front side 1*a* than the fibers 2*b* which are arranged in a felt layer 10*b* which is spaced apart from the front side. Here, the cross section of the fibers used per felt layer may preferably decrease as the spacing of a felt layer from the front side 1*a* increases. Thus, fibers of identical diameter d1 can be contained in a felt layer 10*a* which adjoins the front side 1*a*, and fibers of identical diameter d2 can be contained in a felt layer 10*b* which adjoins the rear side 1*b*, where d1>d2. Here, however, the felt layers can also have fibers with different diameters within the respective felt layer. It may be particularly preferred here if the mean diameter of the fibers contained in a felt layer decreases as the spacing of a felt layer from the front side 1*a* increases.

Figure 7A:
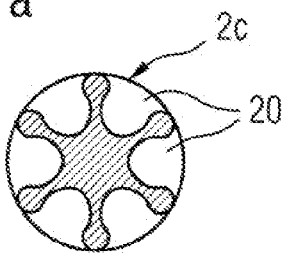
Figure 7B:
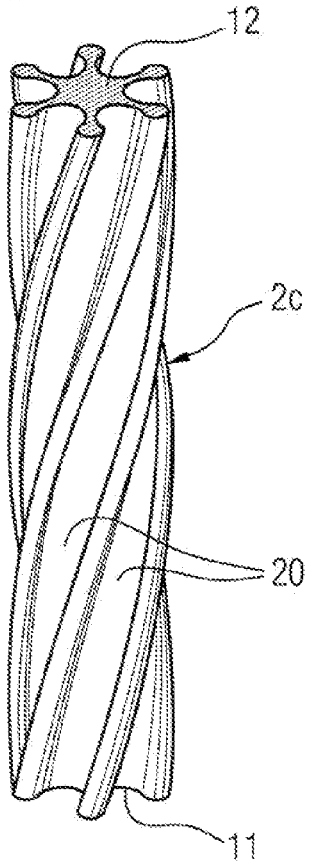

FIG. 7*a* shows an enlarged illustration of a cross section through a fiber 2*c* which has six channels 20 on its fiber surface. FIG. 7*b* shows an enlarged illustration of a three-dimensional view of the fiber 2*c*, it being possible to discern a helical course of the channels 20 along the fiber 2*c*, from the first end 11 in the direction of the second end 12.

Figure 8:
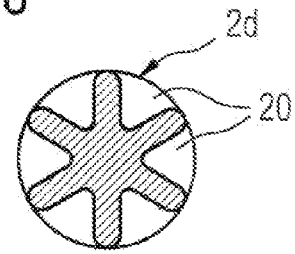

FIG. 8 shows an enlarged illustration of a further cross section through a fiber 2*d* which has six channels 20 on its fiber surface.

Figure 9:
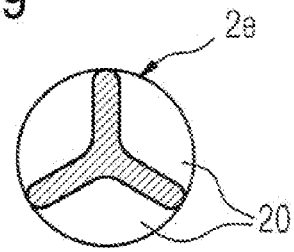

FIG. 9 shows an enlarged illustration of a further cross section through a fiber 2*e* which has three channels 20 on its fiber surface.

Figure 10:
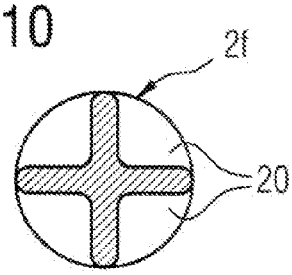

FIG. 10 shows an enlarged illustration of a further cross section through a fiber 2*f* which has four channels 20 on its fiber surface.

Figure 11A:
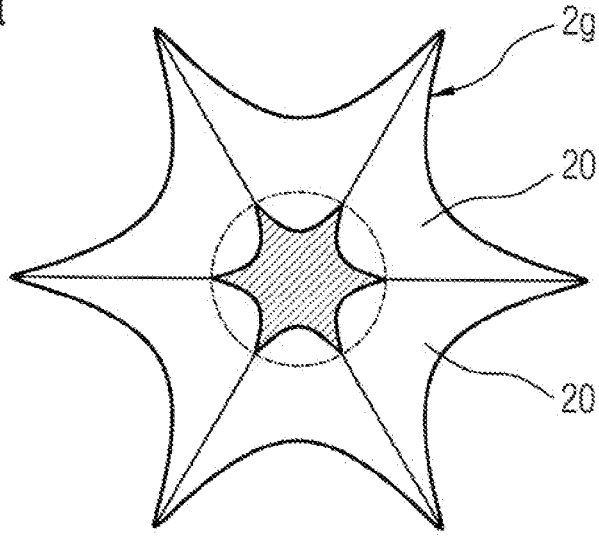
Figure 11B:
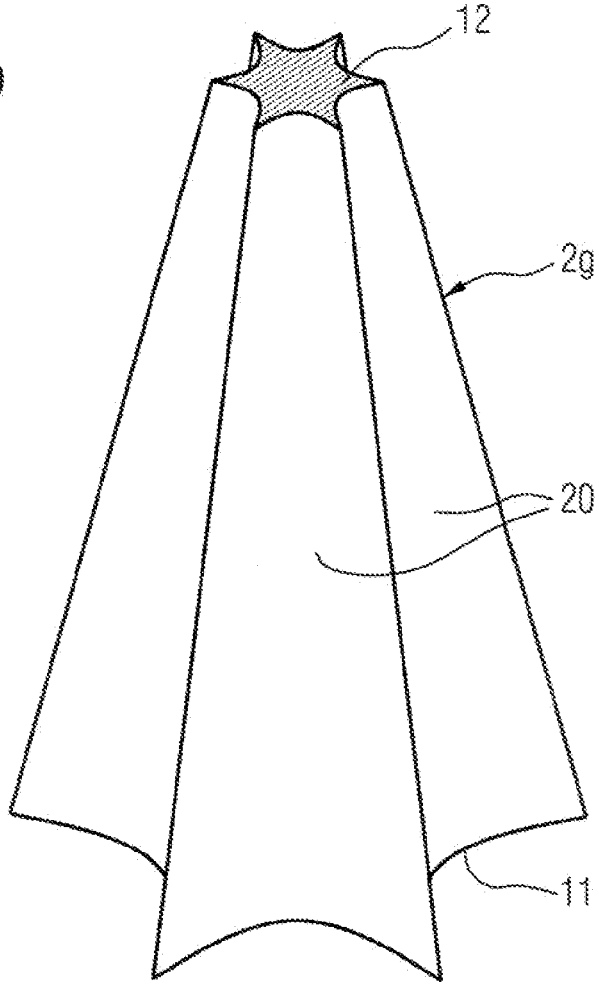

FIG. 11*a* shows an enlarged illustration of a further cross section through a fiber 2*g* which has six channels 20 on its fiber surface. FIG. 11*b* shows an enlarged illustration of a three-dimensional view of the fiber 2*g*, it being possible to discern a straight course of the channels 20 along the fiber 2*g*, from the first end 11 in the direction of the second end 12. Here, the fiber 2*g* has a greater cross section at its first end 11 than at its second end 12.

A fiber with a decreasing diameter may be particularly preferably used in a press felt 1 or a felt layer 10*a*, 10*b* in such a way that the thicker first end of the fiber points in the direction of the front side 1*a* of the press felt 1, in particular adjoins the latter directly.

It goes without saying that a multiplicity of further fibers which are provided with channels and have different fiber cross sections can be used, which are not shown in FIGS. 7*a* to 11*b*.

Figure 12:
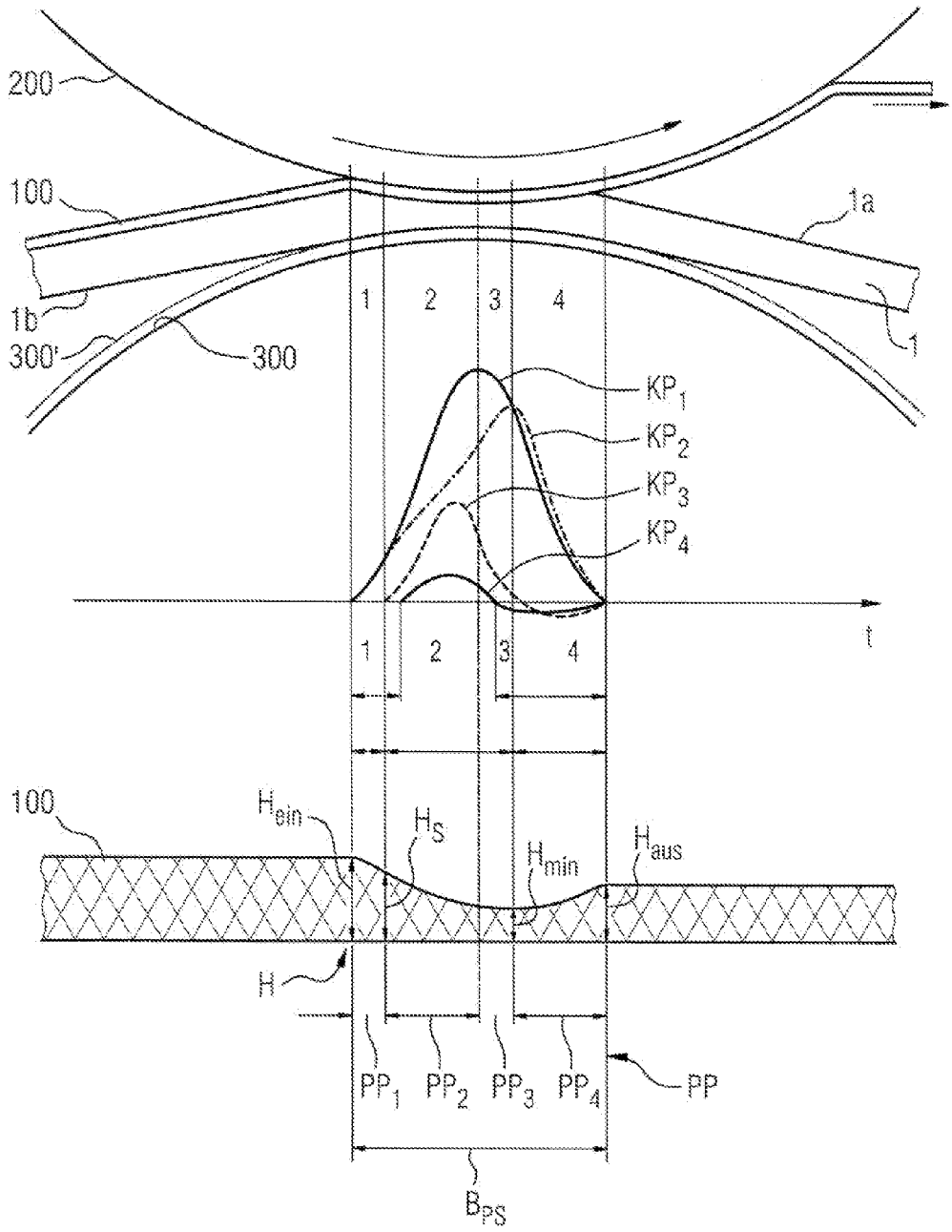

FIG. 12 shows a diagrammatic overview of a typical profile of the dewatering of a paper web 100 in a papermaking machine plotted against time t or against a pressure nip width $B_{PS}$ in side view. The upper part of FIG. 12 shows a pressure nip $B_{PS}$ between two rolls 200, 300 which are operated in opposite directions. A wet paper web 100 is guided on a press felt 1 into the pressure nip and dewatered, by a pressure being applied by means of the rolls 200, 300 and the press felt 1 being pressed with its front side 1*a* against the paper web 100. Here, the water transport mechanism is based on compression, capillary forces and two-phase flow. The water which is pressed out of the paper web 100 is guided away via the press felt 1 in the direction of the roll 300 which has a surface profile 300' for improved absorption of the water. The surface profile 300' is provided, for example, by woven wire fabrics laid onto the roll 300, holes made in the roll 300, grooves or the like. The phases of the pressing operation PP which take place after one another over the pressure nip width in the pressure nip are denoted by PP1 to PP4 and are shown correlated with the pressure distribution curves $KP_1$ to $KP_4$ and the respectively existing thickness H of the paper web 100 which is depicted once again in an enlarged illustration in the lower region of FIG. 12 for improved clarity. Here, $KP_1$ denotes the pressing zone pressure distribution curve, $KP_2$ denotes the pressure distribution curve for the paper web 100 and the press felt 1, $KP_3$ denotes the pressure distribution curve of the hydraulic curve and $KP_4$ denotes the pressure distribution curve of the highest hydraulic pressure for the pressure felt 1. Before the press felt 1 and the paper web 100 enter the pressure nip, the paper web has a thickness $H_{ein}$. In the first phase of the pressing operation PP1, the paper web 100 is compressed until a saturated thickness $H_S$ is achieved. In the second and third phases of the pressing operation PP2, PP3, the paper web is compressed further and the water is pressed out until the point of highest dryness with a minimum thickness $H_{min}$ of the paper web 100 is reached at the end of the third phase PP3. Here, the transition between the second phase PP2 and the third phase PP3 is formed by the connecting line of the centers of rotation of the rolls 200, 300. In the fourth phase PP4, the continuous relieving of the press felt 1 and the dewatered paper web 100 takes place and reabsorption of water into the dewatered paper web 100 occurs on account of the negative hydraulic pressure. As a result, the thickness of the paper web 100 rises again to a value $H_{aus}$. The press felt 1 and the dewatered paper web 100 are separated from one another at the outlet of the fourth phase PP4. The paper web 100 is subsequently detached from the roll 200 and the residual moisture which is still contained is subsequently usually removed by thermal treatment.

In comparison with conventional press felts, the use of a press felt according to various embodiments makes it possible to prevent or at least reduce the reabsorption of water out of the press felt back into the paper web 100. The thickness of the paper web $H_{aus}$ at the outlet of the fourth phase PP4 is therefore approximated to the thickness of the paper web $H_{min}$ at the point of highest dryness.

What is claimed is:

1. A press felt having a front side, a rear side and comprising fibers which, on their fiber surface, have channels which extend between a first end and a second end of the respective fiber, wherein the first end points in the direction of the front side and the second end points in the direction of the rear side; and wherein the fibers have a cross section and the cross section of the first end is larger than the cross section of the second end.

2. The press felt according to claim 1, wherein the press felt has at least two felt layers and a fiber cross section of the fibers which are contained in the respective felt layer is reduced as the spacing increases of a felt layer from the front side of the press felt.

3. The press felt according to claim 2, wherein the fibers extend over a thickness of a felt layer.

4. The press felt according to claim 2, wherein the at least two fiber layers differ, and furthermore, wherein the fibers which are contained in the at least two layers differ with regard to at least one of their number, a number, and an arrangement of the channels.

5. The press felt according to claim 1, wherein the fibers extend from the front side to the rear side of the press felt.

6. The press felt according to claim 1, wherein the fibers differ with regard to at least one of a number and an arrangement of the channels.

7. The press felt according to claim 1, wherein the proportion of fibers in the press felt is at least 1% by volume.

8. The press felt according to claim 1, wherein the proportion of fibers in the press felt is at least 5% by volume.

9. The press felt according to claim 1, wherein the fibers are formed by microfibers.

10. The press felt according to claim 1, wherein the fibers are arranged in fiber bundles.

11. The press felt according to claim 1, wherein the fibers have a star-shaped or cross-shaped fiber cross section.

12. The press felt according to claim 1, wherein the channels extend helically from the first end in the direction of the second end of the respective fiber.

13. The press felt according to claim 1, wherein the fibers or fiber bundles are arranged orthogonally with respect to the front side of the press felt.

14. The press felt according to claim 1, wherein the fibers are adhesively bonded to a carrier structure.

15. The press felt according to claim 14, wherein the carrier structure is formed by at least one of a knitted fabric, a woven fabric, and laid fiber fabrics.

* * * * *